US005906909A

United States Patent [19]

Ellis

[11] Patent Number: 5,906,909

[45] Date of Patent: May 25, 1999

[54] WET LITHOGRAPHIC PRINTING CONSTRUCTIONS INCORPORATING METALLIC INORGANIC LAYERS

[75] Inventor: Ernest Ellis, Harvard, Mass.

[73] Assignee: Presstek, Inc., Hudson, N.H.

[21] Appl. No.: 08/778,962

[22] Filed: Jan. 6, 1997

[51] Int. Cl.[6] ..... B41N 1/08; B41N 1/12

[52] U.S. Cl. ..... 430/302; 101/456

[58] Field of Search ..... 428/469, 472, 428/626, 627, 621, 632, 639; 101/454, 458, 459, 456, 467, 457; 430/302, 200, 201, 945

[56] References Cited

U.S. PATENT DOCUMENTS

| | | | |
|---|---|---|---|
| 3,654,864 | 4/1972 | Ovshinsky | 101/426 |
| 3,679,418 | 7/1972 | Stroszynski | 96/86 |
| 4,082,040 | 4/1978 | Yamashina et al. | 101/456 |
| 4,115,127 | 9/1978 | Ikeda et al. | 96/85 |
| 4,177,072 | 12/1979 | Ono et al. | 430/302 |
| 4,214,249 | 7/1980 | Kasai et al. | 346/76.1 |
| 4,265,987 | 5/1981 | Lawson | 430/49 |
| 4,522,891 | 6/1985 | Iwaki et al. | 428/626 |
| 4,608,131 | 8/1986 | Brenk | 204/33 |
| 4,970,116 | 11/1990 | Kimura et al. | 428/332 |
| 5,165,345 | 11/1992 | Lewis et al. | 101/453 |
| 5,345,869 | 9/1994 | Treverton et al. | 101/454 |
| 5,540,150 | 7/1996 | Lewis et al. | 101/467 |
| 5,783,364 | 7/1998 | Ellis et al. | 430/302 |
| 5,786,129 | 7/1998 | Ellis | 430/302 |

*Primary Examiner*—John J. Zimmerman
*Attorney, Agent, or Firm*—Cesari and McKenna, LLP

[57] ABSTRACT

Lithographic printing members include a traditional flood-exposed photopolymer layer applied to one or more layers based on certain metallic inorganic materials. The metallic inorganic material overlies a substrate, which is preferably a relatively thick metal for dimensional stability and strength, but may also be a polymeric or other material. An intermediate tying layer may anchor the metallic inorganic material to the substrate. The plate is exposed and developed in the conventional manner, with the portions of the metallic inorganic layer exposed by development serving as a hydrophilic printing surface (that is, a surface accepting fountain solution).

19 Claims, 1 Drawing Sheet

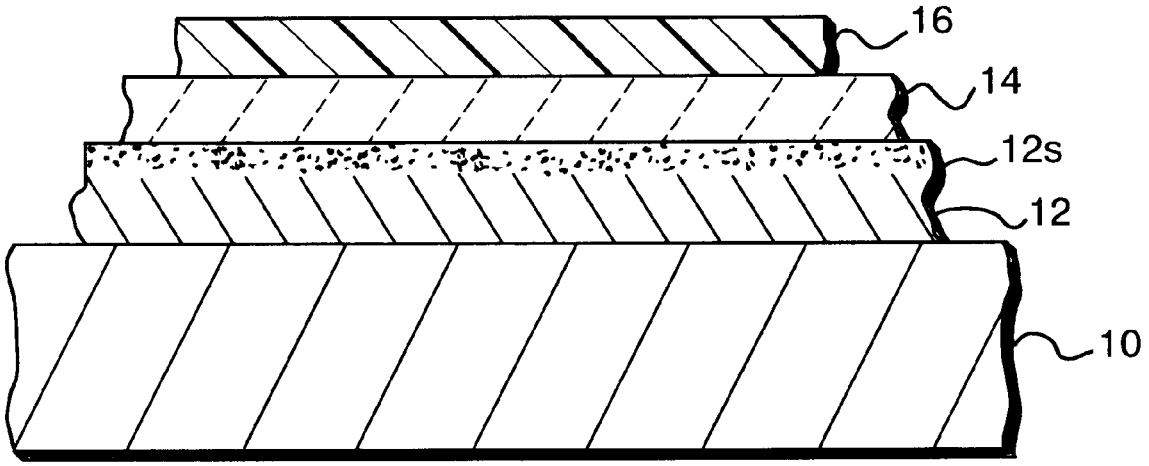
16
14
12s
12
10

WET LITHOGRAPHIC PRINTING CONSTRUCTIONS INCORPORATING METALLIC INORGANIC LAYERS

BACKGROUND OF THE INVENTION

1. Field of the Invention

The present invention relates to printing apparatus and methods, and more particularly to lithographic printing plate constructions that may be imaged on- or off-press.

2. Description of the Related Art

Traditional techniques of introducing a printed image onto a recording material include letterpress, flexographic and gravure printing, and offset lithography. All of these printing methods require a printing member, usually loaded onto or integral with a plate cylinder of a rotary press for efficiency, to transfer ink in the pattern of the image. In letterpress and flexographic printing, the image pattern is represented on the printing member in the form of raised areas that accept ink and transfer it onto the recording medium by impression; flexographic systems, which utilize elastomeric surfaces, have received more widespread acceptance due to the broad variety of compatible substrates and the ability to run with fluid inks. Gravure printing cylinders, in contrast to raised-surface systems, contain series of wells or indentations that accept ink for deposit onto the recording medium; excess ink must be removed from the cylinder by a doctor blade or similar device prior to contact between the cylinder and the recording medium.

In the case of offset lithography, the image is present on a plate or mat as a pattern of ink-accepting (oleophilic) and ink-repellent (oleophobic) surface areas. In a dry printing system, the plate is simply inked and the image transferred onto a recording material; the plate first makes contact with a compliant intermediate surface called a blanket cylinder which, in turn, applies the image to the paper or other recording medium. In typical sheet-fed press systems, the recording medium is pinned to an impression cylinder, which brings it into contact with the blanket cylinder.

In a wet lithographic system, the non-image areas are hydrophilic, and the necessary ink-repellency is provided by an initial application of a dampening (or "fountain") solution to the plate prior to or in conjunction with inking. The ink-rejecting fountain solution prevents ink from adhering to the non-image areas, but does not affect the oleophilic character of the image areas.

The plates for an offset press are usually produced photographically. To prepare a wet plate using a typical negative-working subtractive process, the original document is photographed to produce a photographic negative. This negative is placed on an aluminum plate having a water-receptive, anodized (textured) surface coated with a presensitized photopolymer. Upon exposure to actinic radiation through the negative, the areas of the coating that received radiation (corresponding to the dark or printed areas of the original) cure to a durable oleophilic state. The plate is then subjected to a developing process that removes the uncured areas of the coating (i.e., those which did not receive radiation, corresponding to the non-image or background areas of the original), exposing the hydrophilic surface of the aluminum plate. Conventional wet plates also typically contain primer layers, which provide better anchorage of the photopolymer to the aluminum substrate.

In a positive-working process, the areas of the photosensitive coating that received radiation become labile and are removed by development; it is the unexposed areas that persist and carry ink. Photoexposure processes are well-understood and common in the industry.

Rendering a layer of aluminum, which is hydrophilic but fragile in an unstructured or polished state, sufficiently durable to repeatedly accept fountain solution in a printing environment requires special treatment. Any number of electrochemical techniques, in some cases assisted by the use of fine abrasives to further roughen the surface, may be employed for this purpose. For example, electrograining involves immersion of two opposed aluminum plates (or one plate and a suitable counterelectrode) in an electrolytic cell and passing alternating current between them. The result of this process is a finely pitted surface topography that readily adsorbs water. See, e.g., U.S. Pat. No. 4,087,341.

A structured or grained surface can also be produced by controlled oxidation, a process commonly called "anodizing." The anodized aluminum plate consists of an unmodified base layer and a porous, "anodic" aluminum oxide coating thereover; this coating readily accepts water. However, without further treatment, the oxide coating would lose wettability due to further chemical reaction. Anodized plates are, therefore, typically exposed to a silicate solution or other suitable (e.g., phosphate) reagent that stabilizes the hydrophilic character of the plate surface. In the case of silicate treatment, the surface may assume the properties of a molecular sieve with a high affinity for molecules of a definite size and shape—including, most importantly, water molecules. The treated surface also promotes adhesion to an overlying photopolymer layer. Anodizing and silicate treatment processes are described in U.S. Pat. Nos. 3,181,461 and 3,902,976.

Textured chromium surfaces also exhibit substantial hydrophilic character, and can be used in lieu of aluminum in wet-running lithographic plates. Such surfaces can be produced by, for example, electrodeposition, as described in U.S. Pat. No. 4,596,760. As used herein, the term "textured" refers to any modification to the surface topography of a metal plate that results in enhancement of hydrophilic character.

Although printing plates containing conventional textured substrates exhibit adequate durability in commercial printing contexts, the structured nature of these surfaces renders them vulnerable to eventual wear and degradation. As these surfaces lose structure, hydrophilicity suffers and printing quality deteriorates. This is a largely unavoidable result of systems that rely on structured surfaces yet subject them to the direct action of considerable mechanical pressures and various chemical reagents.

DESCRIPTION OF THE INVENTION

Brief Summary of the Invention

Accordingly, it is an object of the present invention to facilitate long-run printing without deterioration of printing quality.

It is a further object of the invention to provide a method of producing and printing with wet lithographic printing members that exhibit superior tolerance to varying printing conditions.

It is another object of the invention to provide wet lithographic printing members that do not depend on physically modified surfaces.

It is yet another object of the invention to provide wet lithographic members that can be fabricated with conventional equipment and using economical materials.

It is still another object of the invention to provide printing plates having characteristics colors.

The invention accordingly comprises an article of manufacture possessing the features and properties exemplified in the constructions described herein, all as exemplified in the following summary and detailed description, and the scope of the invention will be indicated in the claims.

Brief Summary of the Invention

In accordance with the invention, a traditional flood-exposed, presensitized photopolymer is applied to one or more layers based on certain metallic inorganic materials. These materials are both hydrophilic and very durable, making them desirable for wet-plate constructions. The metallic inorganic layers may be conveniently applied by vacuum coating techniques. The plate is exposed to actinic radiation, which causes the photopolymer to resist (or alternatively to become vulnerable to) the action of a conventional developer. The developer causes removal (or retention) of the unexposed portions of the photopolymer, resulting in an imagewise lithographic pattern.

The metallic inorganic material is deposited onto a substrate, which is preferably a relatively thick metal for dimensional stability and strength, but may also be a polymeric or other material. An intermediate tying layer may be used to anchor the metallic inorganic material to the substrate. Following development, the exposed portions of the metallic inorganic layer serve as a hydrophilic printing surface (that is, a surface accepting fountain solution).

It should be stressed that, as used herein, the term "plate" or "member" refers to any type of printing member or surface capable of recording an image defined by regions exhibiting differential affinities for ink and/or fountain solution; suitable configurations include the traditional planar or curved lithographic plates that are mounted on the plate cylinder of a printing press, but can also include seamless cylinders (e.g., the roll surface of a plate cylinder), an endless belt, or other arrangement.

BRIEF DESCRIPTION OF THE DRAWINGS

The foregoing discussion will be understood more readily from the following detailed description of the invention, when taken in conjunction with the single FIGURE of the drawing, which depicts an enlarged sectional view of a lithographic printing member in accordance with the invention.

DETAILED DESCRIPTION OF THE PREFERRED EMBODIMENTS

FIG. 1 illustrates a representative embodiment of the present invention. The depicted plate construction includes a substrate 10, a tying layer 12, a hydrophilic layer 14, and a photopolymer layer 16. Substrate 10 is preferably strong, stable and flexible, and is preferably a metal sheet, but may instead be a polymer film or a paper sheet. Preferred metal substrates have thicknesses of 0.005 inch or more. For example, the aluminum coil traditionally employed to produce textured-surface plates (by graining and anodizing) can be used in its raw, unmodified state.

If a polymer substrate is to be used, its surface characteristics are important only insofar as they bear on adhesion to the overlying layer or layers; affinity or lack thereof for printing fluids is irrelevant. Suitable substrates include the MYLAR film sold by E.I. duPont de Nemours Co., Wilmington, Del., or, alternatively, the MELINEX film sold by ICI Films, Wilmington, Del. The thickness of a polymer layer is determined primarily by the environment of use; for example, if the material is to be stored in a bulk roll within the interior of a plate cylinder and incrementally advanced around the exterior of the cylinder by a winding mechanism, flexibility will be more important than dimensional stability; thicknesses on the order of 0.007 inch are suitable for such applications.

Paper substrates are typically "saturated" with polymerics to impart water resistance, dimensional stability and strength. A polymeric or paper substrate can, if desired, be laminated onto a heavier metal support using techniques well-known in the art.

Layer 12, which is optional, is a a metal that may or may not develop a native oxide surface 12*s* upon exposure to air during the plate-fabrication process. The thickness of layer 12 is not critical, although it may be desirable to keep this layer thin (e.g., 50–5000 Å) for economic reasons. Layer 12 functions as a tying layer if the surface characteristics of substrate 10 are not well-suited to acceptance and anchorage of the metallic inorganic layer, and may otherwise be omitted. The metal of layer 12 is at least one d-block (transition) metal, aluminum, indium or tin. In the case of a mixture, the metals are present as an alloy or an intermetallic. Oxidation can occur on both metal surfaces, and may also, therefore, affect adhesion of layer 12 to substrate 10 (or other underlying layer). Substrate 10 can also be treated in various ways to improve adhesion to layer 12. For example, plasma treatment of a film surface with a working gas that includes oxygen (e.g., an argon/oxygen mix) results in the addition of oxygen to the film surface, improving adhesion by rendering that surface reactive with the metal(s) of layer 12. Oxygen is not, however, necessary to successful plasma treatment. Other suitable working gases include pure argon, pure nitrogen, and argon/nitrogen mixtures. See, e.g., Bernier et al., *ACS Symposium Series* 440, *Metallization of Polymers,* p. 147 (1990).

Layer 14 is a metallic inorganic layer comprising a compound of at least one metal with at least one non-metal, or a mixture of such compounds. It is generally applied at a thickness of 100–5000 Å or greater; however, optimal thickness is determined primarily by durability concerns, and secondarily by economic considerations and convenience of application. The metal component of layer 14 may be a d-block (transition) metal, an f-block (lanthanide) metal, aluminum, indium or tin, or a mixture of any of the foregoing (an alloy or, in cases in which a more definite composition exists, an intermetallic). Preferred metals include titanium, zirconium, vanadium, niobium, tantalum, molybdenum and tungsten. The non-metal component of layer 14 may be one or more of the p-block elements boron, carbon, nitrogen, oxygen and silicon. A metal/non-metal compound in accordance herewith may or may not have a definite stoichiometry, and may in some cases (e.g., Al-Si compounds) be an alloy. Preferred metal/non-metal combinations include TiN, TiON, $TiO_x$ (where $0.9<x<2.0$), TiAlN, TiAlCN, TiC and TiCN.

Layer 16 is a conventional lithographic photoresponsive material, which is oleophilic in nature. By "photoresponsive" is meant undergoing a change upon exposure to appropriate radiation that alters solubility characteristics to a developing solvent. Thus, exposed portions of layer 16 may harden to withstand the action of developer, or may be rendered soluble in developer. Photoresponsive materials are polymeric in nature and generally have molecular weights of at least 1000. Photoresponsive materials that are rendered insoluble (and thus resistant to development) by appropriate radiation within the visible or ultraviolet ("UV") portions of the electromagnetic spectrum include polymers having olefinic, acryloyl, methacryloyl, cinnamoyl, cinnamylideneacetyl, phenylazido, diazo or α-phenylmaleimido functional groups, typical examples including azidophthalic acid esters of polyvinyl alcohol and β-(4-azidophenol)-phthanol esters of a styrene/maleic anhydride copolymer.

Photoresponsive materials that are solubilized (and thus vulnerable to removal by development) by UV or visible radiation include complexes of diazo compounds with inorganic or organic acids, and products obtained by reacting quinonediazides with appropriate polymeric binders. A typical example is naphthoquinone-1,2-diazido-5-sulfonic acid ester of a novolak resin.

Other suitable materials are well-known and conventional in the art, and are set forth, for example, in U.S. Pat. Nos. 5,053,311, 4,842,990, 4,842,988, 3,511,178, 3,677,178, 3,894,873 and 4,086,093.

In an exemplary embodiment, a deep blue, highly durable wet printing plate is prepared by sputter coating a 14"×16"× 0.006" sheet of lithographic-grade, ungrained aluminum with about 300 Å titanium, followed immediately by a reactively sputter-coated layer of titanium nitride to a thickness of about 1000 Å. A layer of photopolymer is applied to the surface (e.g., using a wire-wound rod or other suitable coating technique) to a thickness that can range from 0.3 to 30 $\mu$m. The plate is then exposed and developed in the conventional manner.

It will therefore be seen that the foregoing approach provides a highly advantageous adaptation of the traditional photoexposure approach to construction of lithographic printing members. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A lithographic printing member comprising:

a. an oleophilic, photoresponsive first layer having a solubility characteristic with respect to a chemical developer, the solubility characteristic altering in response to actinic radiation;

b. a second layer comprising a compound of at least one metal with at least one non-metal, the at least one metal being a d-block transition metal, the non-metal being selected from the group consisting of boron, carbon, nitrogen, and silicon, the second layer being hydrophilic; and c. a substrate comprising at least one of (i) a polymeric film, (ii) a metal sheet having an ungrained surface, and (iii) a paper sheet.

2. The member of claim 1 further comprising a metal layer between the second layer and the substrate, the metal layer enhancing anchorage between the second layer and the substrate.

3. The member of claim 2 wherein the metal layer comprises at least one of (i) a d-block transition metal, (ii) aluminum, (iii) indium and (iv) tin.

4. The member of claim 3 wherein the metal layer is titanium.

5. The member of claim 1 wherein the second layer comprises at least one of (i) titanium, (ii) zirconium, (iii) vanadium, (iv) niobium, (v) tantalum, (vi) molybdenum and (vii) tungsten.

6. The member of claim 1 wherein the second layer comprises a boride.

7. The member of claim 1 wherein the second layer comprises a carbide.

8. The member of claim 1 wherein the second layer comprises a nitride.

9. The member of claim 1 wherein the second layer comprises a carbonitride.

10. The member of claim 1 wherein the second layer comprises a silicide.

11. The member of claim 1 wherein the second layer is TiN.

12. The member of claim 1 wherein the second layer is TiC.

13. The member of claim 1 wherein the second layer is TiCN.

14. The member of claim 1 wherein the second layer is TiON.

15. The member of claim 1 wherein the second layer is TiAlN.

16. The member of claim 1 wherein the second layer is TiAlCN.

17. The member of claim 1 wherein the substrate is metal.

18. The member of claim 17 wherein the substrate has a thickness of at least 0.005 inch.

19. The member of claim 2 wherein the metal layer has a thickness no greater than 5000 Å.

* * * * *